US007867956B2

(12) United States Patent
Asakura et al.

(10) Patent No.: US 7,867,956 B2
(45) Date of Patent: Jan. 11, 2011

(54) UREA-BASED LUBRICATING GREASE COMPOSITION

(75) Inventors: Toshihiro Asakura, Okazaki (JP); Yasushi Kawamura, Tokyo (JP); Hirofumi Kuwabara, Kariya (JP); Takahiro Ozaki, Tokyo (JP); Shigeyuki Sugimori, Kariya (JP); Keiji Tanaka, Tokyo (JP)

(73) Assignee: Shell Oil Company, Houston, TX (US)

( * ) Notice: Subject to any disclaimer, the term of this patent is extended or adjusted under 35 U.S.C. 154(b) by 36 days.

(21) Appl. No.: 11/794,135

(22) PCT Filed: Dec. 23, 2005

(86) PCT No.: PCT/EP2005/057162

§ 371 (c)(1),
(2), (4) Date: Oct. 1, 2007

(87) PCT Pub. No.: WO2006/069986

PCT Pub. Date: Jul. 6, 2006

(65) Prior Publication Data

US 2008/0161214 A1 Jul. 3, 2008

(30) Foreign Application Priority Data

Dec. 27, 2004 (JP) ..... 2004-377794

(51) Int. Cl.
*C10M 169/06* (2006.01)
*C10M 115/08* (2006.01)

(52) U.S. Cl. ..... 508/179; 508/168; 508/552

(58) Field of Classification Search ..... 508/179, 508/168, 552
See application file for complete search history.

(56) References Cited

U.S. PATENT DOCUMENTS

| | | | | |
|---|---|---|---|---|
| 6,444,621 | B1 | 9/2002 | Okaniwa et al. | 508/168 |
| 6,800,595 | B2 * | 10/2004 | Ozaki et al. | 508/154 |
| 2003/0176295 | A1 | 9/2003 | Ozaki et al. | 508/179 |
| 2004/0198617 | A1 * | 10/2004 | Kinoshita et al. | 508/527 |
| 2004/0224859 | A1 | 11/2004 | Numazawa et al. | 508/364 |
| 2006/0068996 | A1 | 3/2006 | Kuwabara et al. | 508/167 |
| 2009/0065287 | A1 | 3/2009 | Kuwabara et al. | 180/444 |

FOREIGN PATENT DOCUMENTS

| | | |
|---|---|---|
| DE | 4393753 | 7/1997 |
| JP | 5066435 | 3/1993 |
| JP | 200164665 | 9/2002 |
| JP | 2002308125 | 10/2002 |
| JP | 2002363589 | 12/2002 |
| JP | 2002363590 | 12/2002 |
| JP | 2002371290 | 12/2002 |
| JP | 2003003185 | 1/2003 |
| JP | 2003335249 | 11/2003 |
| JP | 2004114972 | 4/2004 |
| JP | 2004122858 | 4/2004 |
| JP | 2004144118 | 5/2004 |
| WO | WO9905240 | 2/1999 |
| WO | WO0212418 | 2/2002 |
| WO | WO2004053032 | 6/2004 |

OTHER PUBLICATIONS

International Search Report dated Mar. 9, 2006.

* cited by examiner

*Primary Examiner*—Glenn A Caldarola
*Assistant Examiner*—Vishal Vasisth
(74) *Attorney, Agent, or Firm*—Charles W. Stewart

(57) ABSTRACT

A urea-based lubricating grease composition comprising (a) as a thickener, a diurea compound which is an alkyldiurea compound having an average molecular weight in the range of from 600 to 700, wherein in the range of from 25 to 60 mole % of the total alkyl groups is an unsaturated component, and the total amine value of the primary amine constituting the raw material is in the range of from 250 to 350, (b) a base oil having as its main component one or more synthetic hydrocarbon oil(s) having a pour point of −40° C. or below, wherein the kinematic viscosity of the base oil is 6000 $mm^2$/sec or less at −40° C., and (c) as additives, a mixture comprising an oil-soluble organic molybdenum complex, an oil-soluble organic zinc compound of dithiocarbamic acid, an oil-soluble organic zinc compound of dithiophosphoric acid and an inorganic sulphur compound; and a roller bearing and electric power steering device wherein the said lubricating grease composition is used as the lubricant.

19 Claims, No Drawings

UREA-BASED LUBRICATING GREASE COMPOSITION

This application is a 371 of PCT/EP2005/057162, filed Dec. 23, 2005.

The present application claims priority from Japanese Patent Application No. 2004-377794 filed 27 Dec. 2004.

FIELD OF THE INVENTION

The present invention relates to a urea-based lubricating grease composition and a roller bearing and electric power steering device wherein said urea-based lubricating grease composition is used as a lubricant.

BACKGROUND OF THE INVENTION

In recent years, urea greases have come into use in a wide range of fields since they have higher dropping points than general purpose lithium soap greases wherein lithium soaps are used as thickeners, have excellent thermal stability and excellent abrasion resistance and lubricating properties.

In the vehicle industry, there is a progressive increase in cases where the superior performance of urea greases is utilised because of the higher values required for the heat resistance, abrasion resistance and frictional properties of various vehicle parts, including CVJ (constant velocity joints). However, because of the striking advances in automobile technology and the year by year increase in the values required for each individual vehicle component, simply to maintain the status quo will not do.

In particular, the technical innovation in automobile electric power steering devices is remarkable, such that these devices, which were initially only used in some solar cars and light automobiles, are now very widely installed in small to medium-sized passenger cars. This is a vigorously growing sector wherein the number of such devices installed is almost doubling every year.

At present, the mainstream automobile power steering devices are of the hydraulic type. However, with such hydraulic power steering devices, environmental problems due to the use of hydraulic oil (power steering fluid) must be taken into account. There is an associated loss in engine power when such hydraulic power steering devices are installed because the hydraulic pressure pump required to create the oil pressure is driven by power from the engine, and is continuously driven (even when the steering wheel is not operated). Consequently, this is a factor causing a deterioration in fuel consumption.

In contrast, in electric power steering devices an electric motor is used as the power assist power source. By means of a control unit, it is possible to drive the electric motor only at times when the power assist is necessary. Moreover, since the electric motor drive uses electricity generated when the car is running, the engine power loss is very small. Accordingly, there is a substantial fuel economy effect, and energy consumption is greatly decreased compared to the hydraulic power steering devices.

However, since the power output generated by the current electric power steering devices is still low compared to that from hydraulic power steering devices, it is important not only to increase the electric motor power but also to decrease the load on the motor to the maximum extent by reducing friction among individual component parts as much as possible.

Furthermore, particularly in cold regions, the low temperature starting properties of the electric power steering devices are a major factor. In hydraulic power steering devices, when the engine warms up, the hydraulic pump directly connected to the engine has the effect of warming up each part of the steering device with the hydraulic oil acting as a heat transfer medium. Hence, normal low temperature characteristics were satisfactory for the lubricants used in such devices. However, in the case of electric power steering devices, there is no direct heat source from the engine, and the steering device cannot readily be warmed up.

Consequently, it is essential that the grease used for the components in electric power steering devices should display stable low friction torque properties.

Furthermore, since vehicles are used throughout the world, electric power steering devices which are designed and manufactured to take account of extremely cold conditions of about −40° C., may also face regular use at temperatures of 100° C. or more (arising from heat radiation in engine space and heat radiated from road surface).

Consequently, there is a demand for greases having a long life corresponding to the vehicle lifetime, which greases provide stable low torque properties over a wide temperature range from low to high temperatures, and with which oil film breakdown due to decreased viscosity at high temperature does not occur.

Electric power steering devices are broadly classified into three types: (i) column assist electric power steering devices, (ii) pinion assist electric power steering devices, and (iii) rack assist electric power steering devices.

The decelerator in column assist electric power steering devices and pinion assist electric power steering devices is usually made up of a metal worm gear and a resin worm wheel, and the power assist is effected by transmission of power from the electric motor to the power assist via these gears. At the gear contact areas, sliding friction between resin and metal occurs, and a lubricant is applied to these places.

Japanese Laid-Open Specifications 2001-64665, 2002-308125, 2002-363589, 2002-363590, 2002-371290 and 2003-3185 are literature references relating to lubricants used for prior art column and pinion electric power steering devices.

Japanese Laid-Open Specification 2001-64665 describes automobile steering grease compositions which contain (a) a thickener, (b) a base oil of pour point −40° C. or below, (c) an organic molybdenum compound, (d) melamine isocyanurate, (e) polytetrafluoroethylene and (f) molybdenum disulphide. Said reference discloses that the automobile steering grease compositions exhibit suitable lubricating properties at the engagement areas of gears such as in particular the rack and pinion parts or pinion assist electric power steering hypoid gears. However, those grease compositions are entirely different to the grease composition of the present invention.

Japanese Laid-Open Specification 2002-308125 describes an electric power steering device using as lubricant a grease which has improved lubrication durability at high temperatures, while maintaining a low starting rotational torque at low temperatures. Said reference states that in said grease the base oil is a synthetic hydrocarbon oil, the thickener is selected from a lithium-based complex soap or a urea compound and the lubrication enhancer is selected from a solid lubricant or an oil. Said reference discloses that the electric power steering device has an electric motor to generate the steering assist force and a deceleration device which reduces the rotation speed by means of a gear mechanism connected to the rotating shaft of the motor, at least one deceleration gear of that gear mechanism is made of a synthetic resin, and that synthetic resin gear is lubricated by the grease. However, although a urea thickener is mentioned in the claims concerning said grease composition, there is no disclosure whatever of its specific composition and effects.

Japanese Laid-Open Specification 2002-363589 describes a lubricating grease composition containing a base oil and a thickener, wherein a fluorinated resin powder is blended into the base oil. Said reference indicates that the lubricating grease composition may be used in the decelerators of electric power steering devices and the like.

Japanese Laid-Open Specification 2002-363590 describes a lubricating grease composition containing a base oil and a thickener, wherein Li stearate and Li hydroxystearate are used together, and indicates that said lubricating grease composition may be used in the decelerators of electric power steering devices and the like.

Concerning the decelerators of the electric power steering devices described Japanese Laid-Open Specifications 2002-363589 and 2002-363590 and their specific lubricated regions, it is disclosed for example that these are decelerators using worm wheels made of a synthetic resin such as a polyamide resin, and that the role of the lubricating grease compositions contributing to the reduction of friction in the lubricated regions of the sliding parts (friction surfaces) of both the synthetic worm wheel and the metal worm shaft is important. However, the grease compositions of said references are completely different from the grease composition of the present invention.

Japanese Laid-Open Specification 2002-371290 describes a resin lubricating grease composition containing a thickener and a base oil, and wherein montan wax has been incorporated. Said reference discloses that the decelerators of the electric power steering devices and the specific lubricated parts thereof are the resin (polyamide) worm wheel gear and steel worm gear decelerator mechanism parts. However, although a urea thickener is mentioned in the claims concerning said grease composition, it is of note that montan wax is described as an essential component and the grease composition is a resin lubricating composition. Accordingly, the grease composition of said reference differs completely from the grease composition of the present invention.

Japanese Laid-Open Specification 2003-3185 describes a lubricating resin composition containing a base oil and a thickener, wherein a polyethylene oxide wax has been incorporated. Said reference indicates that it is used in the decelerators of electric power steering devices and the like. The decelerators of the electric power steering devices and the specific lubricated parts thereof are decelerator friction surfaces, comprising the synthetic resin worm wheel and metal worm shaft. However, said resin lubricating composition differs completely from the grease composition of the present invention.

The electric power steering device concerned in the present invention may conveniently be the device in the diagram appended to Japanese Laid-Open Specification 2003-335249. That is to say, said device may conveniently be a rack and pinion electric power steering device comprising a ball screw mechanism 37 and roller bearings 33 and 34 (wherein said numberings correlate to the device numberings stated in said reference), and wherein the power assist is effected in the axial direction by the ball screw connected to the rack shaft. Since this ball screw mechanism resembles the ball screw mechanism mounted in machine tools, the lubricating greases previously used on these parts were the lithium-based greases commonly used in these machine tools.

Further, the rack assist electric power steering device disclosed in Japanese Laid-Open Specification 2003-335249 has the electric motor arranged coaxially with the rack shaft. However, there are also devices wherein the electric motor is arranged not coaxially but parallel to the rack shaft (for example, as in Japanese Laid-Open Specification 2004-114972), and devices wherein the electric motor and the rack shaft are arranged so as to intersect the shaft centre (for example, as in Japanese Laid-Open Specification 2004-122858). In these devices, the electric motor and the ball screw mechanism (ball screw nut) are connected by a means of transmission such as a gear mechanism or a belt.

The 'roller bearings' in the aforesaid electric power steering devices are mainly single row or double row deep groove ball bearings (for example as in Japanese Laid-Open Specification 2004-144118).

However, with the ever-increasing demand for installation in cars, and the increased assist power, improved durability and low torque properties of electric power steering devices and the striking advances in other characteristics thereof, satisfactory durability could no longer be obtained with the lithium-based greases that have been hitherto widely used, stable steering properties from high to low temperatures could no longer satisfactorily be provided, and there were also problems with the low torque properties in lower temperature environments.

Accordingly, it is highly desirable to be able to develop urea-based lubricating grease compositions exhibiting stable low torque properties over a wide temperature range, whose effects can be seen to a marked extent at low temperatures, and with which long-term lubrication can be obtained with no lubricating film breakdown even at high temperatures, and a roller bearing and electric power steering device wherein the said lubricating grease composition is used as the lubricant.

SUMMARY OF THE INVENTION

The present invention surprisingly provides a urea-based lubricating grease composition having advantageous properties, wherein said urea-based lubricating grease composition comprises (a) as a thickener, a diurea compound which is an alkyldiurea compound having an average molecular weight in the range of from 600 to 700, wherein in the range of from 25 to 60 mole % of the total alkyl groups is an unsaturated component, and the total amine value of the primary amine constituting the raw material is in the range of from 250 to 350, (b) a base oil having as its main component one or more synthetic hydrocarbon oil(s) having a pour point of −40° C. or below, wherein the kinematic viscosity of the base oil is 6000 $mm^2$/sec or less at −40° C., and (c) as additives, a mixture comprising an oil-soluble organic molybdenum complex, an oil-soluble organic zinc compound of dithiocarbamic acid, an oil-soluble organic zinc compound of dithiophosphoric acid and an inorganic sulphur compound.

The present invention further provides a roller bearing characterised in that the urea-based lubricating grease composition of the present invention is used as the lubricant therein. Said roller bearing is preferably a ball bearing utilising the rolling of balls. In another embodiment of the present invention there is provided an electric power steering device, characterised in that the urea-based lubricating grease composition of the present invention is used as the lubricant therein. Said electric power steering device preferably uses the lubricating grease composition of the present invention in the roller bearing(s) therein. It is particularly preferred that the roller bearing(s) in said device are ball bearings utilising the rolling of balls.

DETAILED DESCRIPTION OF THE INVENTION

The diurea compound which is present as thickener (a) is made by reaction of a diisocyanate and one or more primary amines (i.e. the so-called "raw material") using known procedures in the art.

In the present invention, if the average molecular weight of the thickener (a) is less than 600 or if the average molecular weight of the thickener (a) exceeds 700, then the ideal action of the grease in the present electric power steering devices is not obtained, and stable torque properties are not adequately obtained.

Furthermore, if the unsaturated component in the total alkyl groups of said thickener (a) is less than 25 mole %, then normal lubricating efficacy in the present electric power steering devices is not obtained, and stable torque properties are not adequately obtained. In addition, if the unsaturated component in the total alkyl groups of said thickener (a) exceeds 60 mole %, then it becomes difficult to ensure adequate heat resistance in the present electric power steering devices, and a decrease in lifetime is to be expected. Furthermore, if the total amine value of the primary amine is outside of the range of from 250 to 350, then it becomes difficult to obtain the ideal action of the grease, the normal oil effect and adequate heat resistance in the present electric power steering devices, stable torque properties are no longer obtained, and a decrease in lifetime is to be expected.

The one or more synthetic hydrocarbon oil(s) which are present in base oil (b) in the present invention may be conveniently selected from poly-α-olefin(s), polybutene(s) and oligomer(s) of ethylene and α-olefin(s) having a pour point of −40° C. or below. The kinematic viscosity of the base oil (b) is 6000 $mm^2$/sec or less at −40° C. Such a base oil (b) exhibits optimal efficacy in the present electric power steering devices. If lubricating oils with a pour point higher than −40° C. or lubricating grease compositions of high base oil viscosity wherein the kinematic viscosity of the base oil exceeds 6000 $mm^2$/sec at −40° C. are used, then the viscoelasticity of the lubricating grease composition itself becomes higher, and the specified steering torque properties at low temperature in the present devices are no longer obtained.

Furthermore, in the base oil (b) used in the lubricating grease composition of the present invention, the said one or more synthetic hydrocarbon oils are used as the main component. Said synthetic hydrocarbon oils have excellent characteristics, such as the fact that fluidity can be maintained even at low temperature as their pour point is low, further, their oxidation stability is good, moreover the oil film can be stably maintained as the decrease in viscosity is small even at high temperature since the viscosity temperature characteristics are excellent (high VI), and they do not have adverse effects such as swelling on components made of synthetic rubber or synthetic resins. Mineral oils, ester-based synthetic oils, polyglycol-based synthetic oils, silicone-based synthetic oils or fluorine-based synthetic oils may be used as part of the base oil (b) in the lubricating grease composition of the present invention. However, such base oils are not suitable for use as the main component of base oil (b). If mineral oils are used as the main component of this base oil (b), then the low temperature properties and heat resistance are inadequate. If ester-based synthetic oils are used as the main component of this base oil (b), then there is a risk of adverse effects such as causing swelling of synthetic rubbers or synthetic resins or causing a decrease in their rigidity. Furthermore, if polyglycol-based synthetic oils are used as the main component of this base oil (b), then heat resistance or lubricating properties as good as those of the synthetic hydrocarbon oils are not obtained.

In addition, whilst silicone-based synthetic oils have excellent heat resistance, satisfactory lubricating properties are difficult to attain. Furthermore, although fluorine-based synthetic oils have extremely good heat resistance, their compatibility with thickeners is limited, and they are very expensive. Consequently, neither silicone-based synthetic oils nor fluorine-based synthetic oils may be used as the main component of base oil (b).

It is preferred that 80 weight % or more of synthetic hydrocarbon oil(s) having a pour point −40° C. or below are present as the main component of base oil (b), based on the total weight of the base oil (b).

Further, if one or more synthetic hydrocarbon oils in base oil (b) are present is an amount of less than 80 weight %, based on the total weight of base oil (b) then stable low torque from normal temperature to low temperatures may not be obtained.

The thickener (a) is preferably present in the lubricating grease composition of the present invention in an amount in the range of from 5 to 15 weight %, based on the total weight of the lubricating grease composition.

If thickener (a) is present in amount of less than 5 weight %, based on the total weight of the lubricating grease composition, then the lubricating grease composition may become too soft, and there is a risk of leakage. However, if said thickener (a) is present in an amount more than 15 weight %, based on the total weight of the lubricating grease composition, then there is a risk of an increase in torque since the flow resistance increases.

The additives (c) are preferably present in the lubricating grease compositions of the present invention in an amount in the range of from 1 to 7 weight %, more preferably in an amount in the range of from 1.5 to 6 weight % and most preferably in an amount in the range of from 2 to 5 weight %, based on the total weight of the lubricating grease composition.

If the additives (c) are present in an amount of less than 1 weight % of the total weight of the lubricating grease composition, then the specified durable long life of the steering devices may not be obtained. If the additives (c) are present in an amount of more than 7 weight % based on the total weight of the lubricating grease composition, then the cost merely increases, but no additional marked effect may be obtained.

As 'oil-soluble organic molybdenum complexes', in the additives (c) of the lubricating grease composition of the present invention, compounds such as the organic molybdenum complexes described in Japanese Laid-Open Specification 5-66435 which are at least 5% soluble in synthetic hydrocarbon oils or mineral oils at normal temperature may be conveniently used.

Furthermore, as 'oil-soluble organic zinc compounds of dithiocarbamic acid', in the additives (c), zinc dithiocarbamates such as sulphurised zinc diethyldithiocarbamate, sulphurised zinc dipropyldithiocarbamate, sulphurised zinc dibutyldithiocarbamate, sulphurised zinc dipentyldithiocarbamate, sulphurised zinc dihexyldithiocarbamate, sulphurised zinc didecyldithiocarbamate, sulphurised zinc diisobutyldithiocarbamate, sulphurised zinc di(2-ethylhexyl)dithiocarbamate, sulphurised zinc diamyldithiocarbamate, sulphurised zinc dilauryldithiocarbamate, sulphurised zinc distearyldithiocarbamate, sulphurised zinc diphenyldithiocarbamate, sulphurised zinc ditolyldithiocarbamate, sulphurised zinc dixylyldithiocarbamate, sulphurised zinc diethylphenyldithiocarbamate, sulphurised zinc dipropylphenyldithiocarbamate, sulphurised zinc dibutylphenyldithiocarbamate, sulphurised zinc dipentylphenyldithiocarbamate, sulphurised zinc dihexylphenyldithiocarbamate, sulphurised zinc diheptylphenyldithiocarbamate, sulphurised zinc dioctylphenyldithiocarbamate, sulphurised zinc dinonylphenyldithiocarbamate, sulphurised zinc didecylphenyldithiocarbamate, sulphurised zinc didodecylphenyldithiocarbamate, sulphurised zinc ditetradecylphenyldithiocarbamate and sulphurised zinc dihexadecylphenyldithiocarbamate may be conveniently used.

As 'oil-soluble organic zinc compound of dithiophosphoric acid' in the additives (c), compounds such as sulphurised zinc diethyldithiophosphate, sulphurised zinc dipropyldithiophosphate, sulphurised zinc dibutyldithiophosphate, sulphurised zinc dipentyldithiophosphate, sulphurised zinc dihexyldithiophosphate, sulphurised zinc didecyldithiophosphate, sulphurised zinc diisobutyldithiophosphate, sulphurised zinc di(2-ethylhexyl)dithiophosphate, sulphurised zinc diamyldithiophosphate, sulphurised zinc dilauryldithiophosphate, sulphurised zinc distearyldithiophosphate, sulphurised zinc diphenyldithiophosphate, sulphurised zinc ditolyldithiophosphate, sulphurised zinc dixylyldithiophosphate, sulphurised zinc diethylphenyldithiophosphate, sulphurised zinc dipropylphenyldithiophosphate, sulphurised zinc dibutylphenyldithiophosphate, sulphurised zinc dipentylphenyldithiophosphate, sulphurised zinc dihexylphenyldithiophosphate, sulphurised zinc diheptylphenyldithiophosphate, sulphurised zinc dioctylphenyldithiophosphate, sulphurised zinc dinonylphenyldithiophosphate, sulphurised zinc didecylphenyldithiophosphate, sulphurised zinc didodecylphenyldithiophosphate, sulphurised zinc ditetradecylphenyldithiophosphate and sulphurised zinc dihexadecylphenyldithiophosphate which are at least 5% soluble in synthetic hydrocarbon oils or mineral oils at normal temperature may be conveniently used.

Moreover, as the 'inorganic sulphur compounds' in the additives (c), compounds such as sodium sulphate, sodium sulphide, sodium thiosulphate and sodium sulphite may be conveniently used.

The lubricating grease composition of the present invention may contain, as required, additional additives such as anti-oxidants, rust inhibitors, metal corrosion inhibitors and oiliness agents (also known as friction modifiers).

Examples of such additives include: as anti-oxidants, 2,6-ditertiary-butyl-4-methylphenol, N-phenyl-α-naphthylamine, octyldiphenylamine and 2,6-ditertiary-butyl paracresol, rust inhibitors such as oxidised paraffin, aminoimidazole, N,N-trimethylenediamine dioleate, sorbiton monooleate, alkenyl succinates and derivatives thereof, ester-type rust inhibitors or amine-type rust inhibitors.

In general, if the low temperature starting characteristics of the grease are considered important, as regards the kinematic viscosity of the base oil (b) used in the grease, thin base oils are often used. However, the lower the base oil viscosity becomes, the more easily boundary lubrication is attained in the sliding surfaces, the greater the frequency of occurrence of oil film breakdown becomes, and the shorter the machine lifetime becomes.

In the present invention, the kinematic viscosity of the base oil (b) at −40° C. is 6,000 $mm^2$/sec or less, and it is of a thinner grade than the usual grease base oils. However, through the incorporation of the special diurea compound which is thickener (a) of the present invention, and the mixture of additives (c), i.e. an oil-soluble organic molybdenum complex, an oil-soluble organic zinc compound of dithiocarbamic acid, an oil-soluble organic zinc compound of dithiophosphoric acid and an inorganic sulphur compound, it is surprisingly possible not only to eliminate the risk of oil film breakdown, but also to effect a further prolongation of working life.

By means of the present invention, it is surprisingly possible to provide a urea-based lubricating grease composition exhibiting advantageous properties such as stable low torque properties over a wide temperature range, whose effects can be seen to a marked extent at low temperatures, and with which long-term lubrication can be obtained, with no lubricating film breakdown even at high temperatures. A roller bearing and electric power steering device wherein the urea-based lubricating grease composition is used as the lubricant are also provided.

The urea-based lubricating grease compositions of the present invention may also be used in joints such as constant velocity joints.

The urea-based lubricating grease composition of the present invention is also particularly suitable as a lubricant for plunging-type constant velocity joints in automobiles.

Constant velocity joints are universal joints which can transfer motive power from an automobile engine to the wheels while maintaining a constant angular velocity and torque. Whilst propeller shafts have been used in most automobiles, modern automobile design is following the trend for front-wheel drive, and there are many types of constant velocity joints permitting this front wheel drive. Constant velocity joints that are also plunging type joints are structured such that they slide in the axial direction; it is friction resistance to this sliding that causes the source vibration that results in vibration and noise within the automobile. Thus, there is a strong demand for a grease composition that is excellent in decreasing interior joint friction.

In a further embodiment of the present invention, there is provided the use of the urea-based lubricating grease composition of the present invention to lubricate a bearing or joint, preferably a roller bearing or a constant velocity joint.

The present invention further provides a method of lubricating a bearing or joint, in particular a roller bearing or constant velocity joint, said method comprising using a urea-based lubricating grease composition according to the present invention.

The present invention further provides a roller bearing characterised in that a urea-based lubricating grease composition according to the present invention is used therein as the lubricant.

Furthermore, the present invention, also provides an electric power steering device, characterised in that a urea-based lubricating grease composition according to the present invention is used therein as there lubricant.

EXAMPLES

The present invention is described below with reference to the following Examples which are not intended to limit the scope of the present invention in any way.

Examples 1-4

The base oil and diisocyanate were placed in an airtight grease trial production device in the compounding proportions shown in Table 1, and heated to 60° C. while stirring. Starting materials made by mixing and dissolving the various amines and base oils were added from a hopper, and the mixture was reacted. In order to bring the reaction to completion, it was heated to 170° C. while stirring, maintained for 30 minutes, then cooled to 80° C., additives in the compounding proportions shown in Table 1 were added. As an oxidation inhibitor, an extra 1.0% of octyldiphenylamine was added (i.e. over and above the rest of the formulation taken as 100%). After allowing to cool to ca. 60° C., the grease was obtained by processing in a triple roller.

Comparative Examples 1-3

The base oil and diisocyanate were placed in an airtight grease trial production device in the compounding proportions shown in Table 2, and heated to 60° C. while stirring. Starting materials made by mixing and dissolving the various amines and base oils were added from a hopper, and the mixture was reacted. In order to bring the reaction to completion, it was heated to 170° C. while stirring, maintained for 30 minutes, then cooled to 80° C., additives in the compounding proportions shown in Table 2 were added. As an oxidation inhibitor, an extra 1.0% of octyldiphenylamine was added (i.e. over and above the rest of the formulation taken as 100%). After allowing to cool to ca. 60° C., the grease was obtained by processing in a triple roller.

Comparative Example 4

Comparative Example 4, which is shown in Table 2, is a third party commercial lithium-based synthetic oil grease widely used in existing electric power steering devices.

The 'diisocyanate' in Table 1 and Table 2 had a molecular weight of 250 and had the following chemical structure.

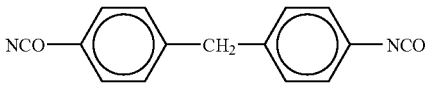

Amine A was a straight-chain primary amine (industrial grade caprylamine) of average molecular weight 130, mainly containing (at least 90%) 8-carbon saturated alkyl groups.

Amine B was a straight-chain primary amine (industrial grade stearylamine) of average molecular weight 270, mainly containing (at least 90%) 18-carbon saturated alkyl groups.

Amine C was a straight-chain primary amine (industrial grade beef tallow amine) of average molecular weight 255, containing ca. 50% of 18-carbon unsaturated alkyl groups, and 14 to 18-carbon saturated or unsaturated alkyl groups.

Amine D was a straight-chain primary amine (industrial grade oleylamine) of average molecular weight 260, mainly containing (at least 70%) 18-carbon unsaturated alkyl groups.

The kinematic viscosity of the mineral oil shown in the Examples and Comparative Examples at 40° C. was 101.5 $mm^2$/sec, and the pour point was −15° C.

The kinematic viscosity of the Synthetic hydrocarbon oil A (CAS No. 68037-01-4) used at 40° C. was 14.94 $mm^2$/sec, the pour point was −67.7° C., and the kinematic viscosity at −40° C. was 3,300 $mm^2$/sec.

Furthermore, the kinematic viscosity of the Synthetic hydrocarbon oil B (CAS No. 68037-01-4) at 40° C. was 396.2 $mm^2$/sec, and the pour point was −36° C.

Additive A was an oil-soluble organic molybdenum compound which was an organic molybdenum complex and is described in Japanese Published Specification 5-66435.

Additive B was an oil-soluble primary Zn-DTP (primary Zn dithiophosphate)

Additive C was an oil-soluble Zn-DTC (Zn dithiocarbamate)

Additive D was sodium thiosulphate.

The characteristics in the Examples and Comparative Examples in each of Tables 1 and 2 were determined by the following test methods:

Consistency: JIS K2220

Dropping point: JIS K2220

Oil separation: JIS K2220B method, carried out under the conditions temperature 100° C. and 24 hrs.

From the experimental results in Tables 1 and 2, the following points became clear.

(1) The urea-based lubricating grease compositions of the present invention showed stable low torque properties over a wide temperature range, and, in particular, showed strikingly good torque properties at low temperatures.

(2) With the urea-based grease compositions of the present invention, adequate lubrication on the lubricated surfaces is possible, the torque variation is small, and even the high temperature life-time is very long.

Electric power steering devices suitable for use in the present invention may be, for example, the device described in Japanese Laid-Open Specification 2003-335249. The structure of this device is as described in that same publication. As shown in FIG. 2 of that publication, the main structure comprises a rack shaft 15 connected to the axle, an electric motor 30 arranged so as to surround this rack shaft 15, and a ball spring mechanism 37 comprising a ball spring groove 15B provided in the outer surface of the aforesaid rack shaft 15 and a ball spring nut 38 attached to one end of the motor shaft 32 of the aforesaid electric motor 30. In this structure, bearings 33 and 34, which support the ball screw mechanism 37 and both ends of the aforesaid motor shaft 32, correspond to the 'roller bearings', and in particular bearings 33 and 34 correspond to the 'ball bearings utilising the rolling of balls'.

Samples using the greases of the afore-mentioned Examples and Comparative Examples as the lubricant in the roller bearings of this electric power steering device were prepared, and the comparison of the performance of these samples was performed in accordance with the following test methods.

1. Low Temperature-Normal Temperature Performance Tests

If the viscosity of the grease increases in the low temperature range, the preload acting on the aforesaid roller bearings increases, and the steering feel may be lost (the steering wheel becomes heavy, and in particular the so-called 'steering wheel return' properties deteriorate). Accordingly, in these experiments the aforesaid preload was measured in the temperature range from ca. −40° C. to ca. 50° C. The temperature referred to here is the surface temperature of the electric power steering device, for example of the housing.

Specifically, the electric power steering device in which the lubricating grease compositions of the Examples and Comparative Examples were used was set up in a condition where the electric motor had not been actuated, that is, in a condition where power assist was not being performed, and in this condition the steering wheel torque necessary to rotate the steering wheel through a specified angle at a steering rate of the degree normally used in an actual vehicle was measured, and these measured values (preload) were assessed comparatively.

It should be noted that in Comparative Example 3, this measurement was omitted.

As a result, it was found that, compared to the lubricating grease compositions of the Comparative Examples, the lubricating grease composition of the Examples showed the same or better performance over the whole temperature range assessed, and the preload was strikingly decreased in the low temperature range in particular. Consequently, through the use of the lubricating grease compositions of the Examples in the 'roller bearings' of the electric power steering device, in particular in the bearings 33 and 34, which are 'ball bearings utilising the rolling of balls', an electric power steering device which shows substantially lower torque properties than previously, in the low temperature range in particular, is obtained. By means of this electric power steering device, even under circumstances directly after the engine has started and is not warmed up, or in extremely cold regions, a satisfactory steering feel is obtained, and in particular so-called 'steering wheel return' can be effected smoothly, hence displaying the superiority of the lubricating grease compositions of the present invention.

2. Temperature Performance and Durability Performance Tests

If the viscosity of a grease decreases in the high temperature range, a condition sometimes occurs wherein the oil film which should be formed by the grease in the aforesaid roller bearings practically disappears (oil film breakdown). Further, oil film breakdown also occurs because of deterioration and ablation of the grease due to prolonged use. Moreover, if this oil film breakdown increases and baking (solidification) takes place, the smooth rolling of the balls in the roller bearings is prevented, and the steering feel is lost. Hence, these tests were performed at the high temperature of about 120° C. air temperature, the aforesaid roller bearings being run for a defined number of revolutions.

Specifically, the first bearing 33 or second bearing 34 of the electric power steering device shown in FIG. 2 of Japanese Laid-Open Specification 2003-335249 were separately subjected to forward rotation and reverse rotation running, and at the 1.5 and 3 million revolution time points the presence or absence of bearing damage and grease solidification and the like was checked, and the high temperature performance and durability performance comparatively assessed.

Here, the results obtained with the first bearing 33 are described in the Examples and Comparative Examples, and from these it was found that the high temperature performance and durability performance are improved through the use of the lubricating grease compositions of the present invention (in Comparative Examples 3 and 4, at the 3 million revolution time point, solidification of the grease and destruction of the bearing had occurred). Thus, as a result of the use of the lubricating grease compositions of the Examples in the bearing devices of the electric power steering device, oil film breakdown and baking and the like in the high temperature range are unlikely to occur, further, electric power steering devices are obtained which can be anticipated to be highly reliable even with prolonged use.

The 'electric power steering devices' suitable for the present invention are not limited to the afore-mentioned device and, for example, those devices described in Japanese Laid-Open Specification 2004-114972 and Japanese Laid-Open Specification 2004-122858 can also be used. In the case of Japanese Laid-Open Specification 2004-114972, the ball spring mechanism 2 and various ball bearings described therein correspond to the 'roller bearing(s)' and in particular the bearings 8 and 10, which support the nut part 2a correspond to the 'ball bearings utilising the rolling of balls'. In the case of Japanese Laid-Open Specification 2004-122858, the ball spring mechanism 9 (19, 29) and various ball bearings described therein correspond to the 'roller bearing(s)' and in particular the bearing 10 (20), which supports the nut part 9*a* (19*a*, 29*a*) corresponds to the 'ball bearings utilising the rolling of balls'.

Further, 'roller bearing' is not limited to deep groove ball bearings, and multipoint contact ball bearings and also needle roller bearings can also be used.

TABLE 1

| | Examples | | | |
|---|---|---|---|---|
| | 1 | 2 | 3 | 4 |
| Diisocyanate (mole ratio) | 1.0 | 1.0 | 1.0 | 1.0 |
| Amine A (mole ratio) | 1.25 | 0.75 | 0.75 | 0.75 |
| Amine B (mole ratio) | — | 0.25 | — | — |
| Amine C (mole ratio) | — | 0.75 | 0.625 | — |
| Amine D (mole ratio) | 0.75 | 0.25 | 0.625 | 1.25 |
| Average molecular weight of thickener (mole MW) | 608.8 | 673.0 | 672.7 | 676.3 |
| Quantity of unsaturated component contained in total alkyl groups in thickener (mole %) | 39.2 | 27.2 | 41.8 | 56.9 |
| Total amine value of amine raw material (mg KOH/g) | 313.8 | 265.7 | 266.2 | 264.6 |
| Quantity of thickener (%) | 9.5 | 7.5 | 8.5 | 8.0 |
| Mineral oil (%) | — | — | — | 5.0 |
| Synthetic hydrocarbon oil A (%) | 87.0 | 84.5 | 87.5 | 83.0 |
| Synthetic hydrocarbon oil B (%) | — | 5.0 | — | — |
| Additive A (%) | 1.25 | 1.0 | 2.0 | 1.5 |
| Additive B (%) | 0.75 | 0.5 | 0.7 | 1.0 |
| Additive C (%) | 0.75 | 0.5 | 1.0 | 1.0 |
| Additive D (%) | 0.75 | 1.0 | 0.3 | 0.5 |
| Total additives (%) | 3.5 | 3.0 | 4.0 | 4.0 |
| Consistency | 283 | 323 | 302 | 307 |
| Dropping point (° C.) | 238 | 222 | 201 | 212 |
| Oil separation (mass %) | 2.8 | 3.0 | 3.3 | 3.5 |
| Base oil kinematic viscosity 40° C. ($mm^2$/sec) | 14.94 | 17.69 | 14.94 | 16.4 |
| Base oil kinematic viscosity at −40° C. ($mm^2$/sec) | 3,300 | 4,475 | 3,300 | 4,240 |
| Base oil pour point (° C.) | −67.7 | −58.3 | −67.7 | −55.4 |
| Tests on electric power steering devices | | | | |
| 1. Low to normal temperature performance test: 30°/s preload (relative ratios taking Comparative Example 1 preload at −20° C. as 1.0) | | | | |
| −40° C. | 1.25 | 1.28 | 1.12 | 1.32 |
| −20° C. | 0.43 | 0.45 | 0.41 | 0.49 |
| 0° C. | 0.3 | 0.28 | 0.28 | 0.29 |
| 20° C. | 0.25 | 0.21 | 0.24 | 0.23 |
| 50° C. | 0.22 | 0.16 | 0.18 | 0.18 |
| 2. High temperature performance and durability performance tests: | | | | |
| 120° C., 1.5 million revolutions | normal | normal | normal | normal |
| 120° C., 3.0 million revolutions | normal | normal | normal | normal |

TABLE 2

| | Comparative Examples | | | |
|---|---|---|---|---|
| | 1 | 2 | 3 | 4 |
| Diisocyanate (mole ratio) | 1.0 | 1.0 | 1.0 | Third party commercial grease for electric |
| Amine A (mole ratio) | 1.25 | 0.75 | 0.75 | |

TABLE 2-continued

| | Comparative Examples | | | |
|---|---|---|---|---|
| | 1 | 2 | 3 | 4 |
| Amine B (mole ratio) | — | 0.25 | — | power steering devices (lithium-based synthetic grease) |
| Amine C (mole ratio) | — | 0.75 | 1.25 | |
| Amine D (mole ratio) | 0.75 | 0.25 | — | |
| Average molecular weight of thickener (mole MW) | 608.8 | 673.0 | 666.3 | |
| Quantity of unsaturated component contained in total alkyl groups in thickener (mole %) | 39.2 | 27.2 | 34.2 | |
| Total amine value of amine raw material (mg KOH/g) | 313.8 | 265.7 | 269.7 | |
| Quantity of thickener (%) | 7.0 | 9.5 | 8.0 | |
| Mineral oil (%) | 44.5 | — | — | |
| Synthetic hydrocarbon oil A (%) | 44.5 | 71.5 | 91.2 | |
| Synthetic hydrocarbon oil B (%) | — | 15.0 | — | |
| Additive A (%) | 1.5 | 1.5 | 0.2 | |
| Additive B (%) | 1.0 | 1.0 | 0.2 | |
| Additive C (%) | 1.0 | 1.0 | 0.2 | |
| Additive D (%) | 0.5 | 0.5 | 0.2 | |
| Total additives (%) | 4.0 | 4.0 | 0.8 | |
| Consistency | 339 | 283 | 311 | 256 |
| Dropping point (° C.) | 191 | 221 | 211 | 191 |
| Oil separation (mass %) | 3.9 | 2.9 | 3.8 | 0.34 |
| Base oil kinematic viscosity 40° C. ($mm^2$/sec) | 35.43 | 25.4 | 14.94 | 26.4 |
| Base oil kinematic viscosity at −40° C. ($mm^2$/sec) | 36,498 | 8,450 | 3,300 | |
| Base oil pour point (° C.) | −36.4 | −49.3 | −67.7 | −50 or lower |
| Tests on electric power steering devices | | | | |
| 1. Low to normal temperature performance test: 30°/s preload (relative ratios taking Comparative Example 1 preload at −20° C. as 1.0) | | | | |
| −40° C. | 3.6 | 2 | — | 2.8 |
| −20° C. | 1 | 0.58 | — | 0.71 |
| 0° C. | 0.41 | 0.3 | — | 0.36 |
| 20° C. | 0.2 | 0.25 | — | 0.31 |
| 50° C. | 0.15 | 0.21 | — | 0.29 |

TABLE 2-continued

| | Comparative Examples | | | |
|---|---|---|---|---|
| | 1 | 2 | 3 | 4 |
| 2. High temperature performance and durability performance tests: | | | | |
| 120° C., 1.5 million revolutions | — | — | Normal | Normal |
| 120° C., 3.0 million revoluations | — | — | Solidification and bearing destruction | Solidification and bearing destruction |

What is claimed is:

1. A urea-based lubricating grease composition having stable low torque properties over a wide temperature range comprising (a) as a thickener, from 5 to 15 weight %, based on the total weight of lubricating grease composition, of an alkyldiurea compound having an average molecular weight in the range of from 600 to 700, wherein in the range of from 25 to 60 mole % of the total alkyl groups is an unsaturated component, and the total amine value of the primary amine constituting the raw material is in the range of from 250 to 350, (b) a base oil having as its main component one or more synthetic hydrocarbon oil(s) having a pour point of −40° C. or below, wherein the one or more synthetic hydrocarbon oils are present in an amount of 80 weight % or more, based on the total weight of the base oil (b), and wherein the kinematic viscosity of the base oil is 6000 $mm^2$/sec or less at −40° C., and (c) as additives, an amount in the range of from 1.5 to 7 weight %, based on the total weight of the lubricating grease composition, of a mixture comprising an oil-soluble organic molybdenum complex, an oil-soluble organic zinc compound of dithiocarbamic acid, an oil-soluble organic zinc compound of dithiophosphoric acid and an inorganic sulphur compound selected from the group consisting of sodium sulphate, sodium sulphide, sodium thiosulphate and sodium sulphite.

2. Urea-based lubricating grease composition according to claim 1, wherein the one or more synthetic hydrocarbon base oils are selected from the group consisting of poly-α-olefin(s), polybutene(s) and oligomer(s) of ethylene and α-olefin(s).

3. Urea-based lubricating grease composition according to claim 1, wherein the additives (c) are present in an amount in the range of from 1.5 to 6 weight %, based on the total weight of the lubricating grease composition.

4. Urea-based lubricating grease composition according to claim 2, wherein the additives (c) are present in an amount in the range of from 2 to 5 weight %, based on the total weight of the lubricating grease composition.

5. Urea-based lubricating grease composition according to claim 1, wherein the inorganic sulphur compound is sodium thiosulphate.

6. A process of using a urea-based lubricating grease composition having stable low torque properties over a wide temperature range comprising (a) as a thickener, from 5 to 15 weight %, based on the total weight of lubricating grease composition, of an alkyldiurea compound having an average molecular weight in the range of from 600 to 700, wherein in the range of from 25 to 60 mole % of the total alkyl groups is an unsaturated component, and the total amine value of the primary amine constituting the raw material is in the range of from 250 to 350, (b) a base oil having as its main component one or more synthetic hydrocarbon oil(s) having a pour point of −40° C. or below, wherein the one or more synthetic hydrocarbon oils are present in an amount of 80 weight % or more, based on total weight of the base oil (b) and wherein the kinematic viscosity of the base oil is 6000 $mm^2$/sec or less at −40° C., and (c) as additives, an amount in the range of from 1.5 to 7 weight %, based on the total weight of the lubricating grease composition, of a mixture comprising an oil-soluble organic molybdenum complex, an oil-soluble organic zinc compound of dithiocarbamic acid, an oil-soluble organic zinc compound of dithiophosphoric acid and an inorganic sulphur compound selected from the group consisting of sodium sulphate, sodium sulphide, sodium thiosulphate and sodium sulphite, to lubricate a bearing or joint wherein the process comprises lubricating the bearing or joint.

7. A method of lubricating a bearing or joint, said method comprising using a urea-based lubricating grease composition having stable low torque properties over a wide temperature range comprising (a) as a thickener, from 5 to 15 weight %, based on the total weight of lubricating grease composition, of an alkyldiurea compound having an average molecular weight in the range of from 600 to 700, wherein in the range of from 25 to 60 mole % of the total alkyl groups is an unsaturated component, and the total amine value of the primary amine constituting the raw material is in the range of from 250 to 350, (b) a base oil having as its main component one or more synthetic hydrocarbon oil(s) having a pour point of −40° C. or below, wherein the one or more synthetic hydrocarbon oils are present in an amount of 80 weight % or more, based on total weight of the base oil (b) and wherein the kinematic viscosity of the base oil is 6000 $mm^2$/sec or less at −40° C., and (c) as additives, an amount in the range of from 1.5 to 7 weight %, based on the total weight of the lubricating grease composition, of a mixture comprising an oil-soluble organic molybdenum complex, an oil-soluble organic zinc compound of dithiocarbamic acid, an oil-soluble organic zinc compound of dithiophosphoric acid and an inorganic sulphur compound selected from the group consisting of sodium sulphate, sodium sulphide, sodium thiosulphate and sodium sulphite.

8. A roller bearing wherein a urea-based lubricating grease having stable low torque properties over a wide temperature range composition comprising (a) as a thickener, from 5 to 15 weight %, based on the total weight of lubricating grease composition, of an alkyldiurea compound having an average molecular weight in the range of from 600 to 700, wherein in the range of from 25 to 60 mole % of the total alkyl groups is an unsaturated component, and the total amine value of the primary amine constituting the raw material is in the range of from 250 to 350, (b) a base oil having as its main component one or more synthetic hydrocarbon oil(s) having a pour point of −40° C. or below, wherein the one or more synthetic hydrocarbon oils are present in an amount of 80 weight % or more, based on total weight of the base oil (b) and wherein the kinematic viscosity of the base oil is 6000 $mm^2$/sec or less at −40° C., and (c) as additives, an amount in the range of from 1.5 to 7 weight %, based on the total weight of the lubricating grease composition, of a mixture comprising an oil-soluble organic molybdenum complex, an oil-soluble organic zinc compound of dithiocarbamic acid, an oil-soluble organic zinc compound of dithiophosphoric acid and an inorganic sulphur compound selected from the group consisting of sodium sulphate, sodium sulphide, sodium thiosulphate and sodium sulphite; is used therein as the lubricant.

9. An electric power steering device, wherein a urea-based lubricating grease composition having stable low torque properties over a wide temperature range comprising (a) as a thickener, from 5 to 15 weight %, based on the total weight of lubricating grease composition, of an alkyldiurea compound having an average molecular weight in the range of from 600 to 700, wherein in the range of from 25 to 60 mole % of the total alkyl groups is an unsaturated component, and the total amine value of the primary amine constituting the raw material is in the range of from 250 to 350, (b) a base oil having as its main component one or more synthetic hydrocarbon oil(s) having a pour point of −40° C. or below, wherein the one or more synthetic hydrocarbon oils are present in an amount of 80 weight % or more, based on total weight of the base oil (b) and wherein the kinematic viscosity of the base oil is 6000 $mm^2$/sec or less at −40° C., and (c) as additives, an amount in the range of from 1.5 to 7 weight %, based on the total weight of the lubricating grease composition, of a mixture comprising an oil-soluble organic molybdenum complex, an oil-soluble organic zinc compound of dithiocarbamic acid, an oil-soluble organic zinc compound of dithiophosphoric acid and an inorganic sulphur compound selected from the group consisting of sodium sulphate, sodium sulphide, sodium thiosulphate and sodium sulphite, is used therein as the lubricant.

10. Urea-based lubricating grease composition according to claim 2, wherein the additives (c) are present in an amount in the range of from 1.5 to 6 weight %, based on the total weight of the lubricating grease composition.

11. Urea-based lubricating grease composition according to claim 10, wherein the one or more synthetic hydrocarbon oils are selected from the group consisting of poly-α-olefins, polybutenes and oligomers of ethylene and α-olefins.

12. Urea-based lubricating grease composition according to claim 3, wherein the additives (c) are present in an amount in the range of from 2 to 5 weight %, based on the total weight of the lubricating grease composition.

13. Urea-based lubricating grease composition according to claim 2, wherein the inorganic sulphur compound is sodium thiosulphate.

14. Urea-based lubricating grease composition according to claim 3, wherein the additives (c) includes an oil soluble zinc primary dithiophosphate.

15. Urea-based lubricating grease composition according to claim 4, wherein the additives (c) includes an oil soluble zinc dithiocarbamate.

16. A process of using a urea-based lubricating grease composition having stable low torque properties over a wide temperature range comprising (a) as a thickener, from 5 to 15 weight %, based on the total weight of lubricating grease composition, of an alkyldiurea compound having an average molecular weight in the range of from 600 to 700, wherein in the range of from 25 to 60 mole % of the total alkyl groups is an unsaturated component, and the total amine value of the primary amine constituting the raw material is in the range of from 250 to 350, (b) a base oil having as its main component one or more synthetic hydrocarbon oil(s) having a pour point of −40° C. or below, wherein the one or more synthetic hydrocarbon oils are present in an amount of 80 weight % or more, based on total weight of the base oil (b) and wherein the kinematic viscosity of the base oil is 6000 $mm^2$/sec or less at −40° C., and (c) as additives, an amount in the range of from 1.5 to 7 weight %, based on the total weight of the lubricating grease composition, of a mixture comprising an oil-soluble organic molybdenum complex, an oil-soluble organic zinc compound of dithiocarbamic acid, an oil-soluble organic zinc compound of dithiophosphoric acid and an inorganic sulphur compound selected from the group consisting of sodium sulphate, sodium sulphide, sodium thiosulphate and sodium sulphite; to lubricate a roller bearing or a constant velocity joint, wherein the process comprises lubricating the roller bearing or the constant velocity joint.

17. A method of lubricating a roller bearing or constant velocity joint, said method comprising lubricating said roller bearing or constant velocity joint using a urea-based lubricating grease composition having stable low torque properties over a wide temperature range comprising (a) as a thickener, from 5 to 15 weight %, based on the total weight of lubricating grease composition, of an alkyldiurea compound having an average molecular weight in the range of from 600 to 700, wherein in the range of from 25 to 60 mole % of the total alkyl groups is an unsaturated component, and the total amine value of the primary amine constituting the raw material is in the range of from 250 to 350, (b) a base oil having as its main component one or more synthetic hydrocarbon oil(s) having a pour point of −40° C. or below, wherein the one or more synthetic hydrocarbon oils are present in an amount of 80 weight % or more, based on total weight of the base oil (b) and wherein the kinematic viscosity of the base oil is 6000 $mm^2$/sec or less at −40° C., and (c) as additives, an amount in the range of from 1.5 to 7 weight %, based on the total weight of the lubricating grease composition, of a mixture comprising an oil-soluble organic molybdenum complex, an oil-soluble organic zinc compound of dithiocarbamic acid, an oil-soluble organic zinc compound of dithiophosphoric acid and an inorganic sulphur compound selected from the group consisting of sodium sulphate, sodium sulphide, sodium thiosulphate and sodium sulphite.

18. Urea-based lubricating grease composition according to claim 3, wherein the thickener is present in an amount in the range of from 7.5 to 9.5 weight %, based on the total weight of the lubricating grease composition.

19. Urea-based lubricating grease composition according to claim 4, wherein the thickener is present in an amount in the range of from 7.5 to 9.5 weight %, based on the total weight of the lubricating grease composition.

* * * * *